US008083223B2

(12) United States Patent
Ikeda

(10) Patent No.: US 8,083,223 B2
(45) Date of Patent: Dec. 27, 2011

(54) SHEET CONVEYING APPARATUS AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 12/569,014

(22) Filed: Sep. 29, 2009

(65) Prior Publication Data

US 2010/0090392 A1 Apr. 15, 2010

(30) Foreign Application Priority Data

Oct. 9, 2008 (JP) ..... 2008-263003

(51) Int. Cl.
*B65H 1/00* (2006.01)

(52) U.S. Cl. ..... 271/145; 271/171; 271/1

(58) Field of Classification Search ..... 271/171, 271/145, 1

See application file for complete search history.

(56) References Cited

U.S. PATENT DOCUMENTS

| | | | | |
|---|---|---|---|---|
| 1,675,525 | A * | 7/1928 | Lester | 271/104 |
| 4,575,298 | A * | 3/1986 | Maas et al. | 414/795.5 |
| 5,135,213 | A * | 8/1992 | Malachowski et al. | 271/104 |
| 5,190,276 | A * | 3/1993 | Namba et al. | 271/13 |
| 5,290,023 | A * | 3/1994 | Sasaki et al. | 271/20 |
| 5,645,274 | A * | 7/1997 | Ubayashi et al. | 271/94 |
| 5,893,554 | A * | 4/1999 | Okahashi et al. | 271/98 |
| 6,113,092 | A * | 9/2000 | Greive et al. | 271/113 |
| 6,746,011 | B2 * | 6/2004 | Miller et al. | 271/97 |
| 7,290,764 | B2 * | 11/2007 | Marasco | 271/145 |
| 2007/0228639 | A1 * | 10/2007 | Matsumoto et al. | 271/97 |
| 2007/0284805 | A1 * | 12/2007 | Ikeda | 271/11 |
| 2008/0315498 | A1 * | 12/2008 | Ikeda | 271/18 |

FOREIGN PATENT DOCUMENTS

| | | |
|---|---|---|
| JP | 7-196187 | 8/1995 |
| JP | 2000-229732 | 8/2000 |
| JP | 3781248 | 5/2006 |

* cited by examiner

*Primary Examiner* — Kaitlin Joerger
(74) *Attorney, Agent, or Firm* — Fitzpatrick, Cella, Harper & Scinto

(57) ABSTRACT

The present invention provides a sheet conveying apparatus and an image forming apparatus which can obtain high operability and productivity when a tabbed sheet is conveyed. In the representative configuration thereof, a trailing edge regulation plate is abutted on tab portions of some of tabbed sheets stacked and supported on a tray to regulate the position of the tabbed sheet. Tab portion regulation portions of a tabbed sheet regulation unit provided at the upper end of the trailing edge regulation plate are abutted on the tab portion of the tabbed sheet formed in the position where the tab portion is not abutted on the regulation portion and regulate the position of the tabbed sheet. The tab portion regulation portions of the tabbed sheet regulation unit can be moved. The tab portion regulation portions are moved with the lifting of the tray when being abutted on the lifting tray.

14 Claims, 19 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus. The present invention relates to a tabbed sheet regulation unit which is used to convey a tabbed sheet.

2. Description of the Related Art

An image forming apparatus such as a printer and a copying machine has a sheet conveying apparatus which conveys each of plural sheets from a sheet storage portion which stores the sheets. As such sheet conveying apparatus, there is a sheet conveying apparatus of an air sheet feeding system which blows air to the edge of a sheet bundle supported on a tray which can be lifted and lowered, blows up plural sheets, absorbs only one of them to an absorption conveying belt disposed above, and conveys it (see Japanese Patent Application Laid-Open (JP-A) No. 7-196187).

FIG. 13 illustrates an example of such related art sheet conveying apparatus of an air sheet feeding system. As illustrated in FIG. 13, a tray 12 which stacks and supports plural sheets S is provided in a storage case 11 which is a sheet storage portion storing the sheets S so as to be lifted and lowered.

When each of the sheets S is set on the tray 12, the position of the downstream edge in a sheet conveying direction (hereinafter, called the leading edge) of the sheet S is held by a leading edge regulation plate 17 and the position of the upstream edge in a sheet conveying direction (hereinafter, called the trailing edge) of the sheet S is held by a trailing edge regulation plate 13. The positions of both side edges in a direction perpendicular to a sheet conveying direction (hereinafter, called a width direction) are held by side regulation plates 14.

The storage case 11 has in its upper portion an absorption conveying portion 20 which absorbs and conveys the sheet S, and an air blowing portion 30 which blows air to the edge of the sheet bundle on the tray, blows up the plural sheets S, and separates each of them.

The absorption conveying portion 20 has an absorption conveying belt 21 which is entrained onto a belt drive roller 41 and absorbs the sheet S to convey it in a right direction in the drawing, and an absorption fan 36 which causes a negative pressure for absorbing the sheet S to the absorption conveying belt 21. The absorption conveying portion 20 has a suction duct 22 which is arranged inside the absorption conveying belt 21 and takes in air through a suction hole formed in the absorption conveying belt 21. To turn on and off the absorption operation of the absorption fan 36, the absorption conveying portion 20 has an absorption shutter 37 between the absorption fan 36 and the suction duct 22.

The air blowing portion 30 has a loosening nozzle 33 and a separation nozzle 34 which blow air to the upper portion of the stored sheet bundle, a separation fan 31, and a separation duct 32 which sends air from the separation fan 31 to the nozzles 33 and 34.

Part of air taken in the direction of the arrow C by the separation fan 31 passes through the separation duct 32, is blown in the direction of the arrow D by the loosening nozzle 33, and blows up several upper sheets of the sheet bundle supported on the tray 12. Other air is blown in the direction of the arrow E by the separation nozzle 34 and separates the uppermost one of the several sheets blown up by the loosening nozzle 33 to press the sheet to the absorption conveying belt 21.

Such sheet conveying apparatus is often adopted in a high-speed apparatus which can convey over 70 A4-size sheets per minute. The tray 12 has a mechanism which is lifted and lowered in a vertical direction by the driving unit, not illustrated, while maintaining the substantially horizontal state.

FIG. 14 is a plan view illustrating the detail of the storage case 11. The trailing edge regulation plate 13 which regulates the trailing edge of the sheet can be moved in parallel with a sheet conveying direction indicated by the arrow H. The side regulation plates 14 and 16 which regulate the side edges of the sheet can be moved in a sheet width direction indicated by the arrow V.

In this manner, the trailing edge regulation plate 13 and the side regulation plates 14 and 16 can be moved. Therefore a smallest size sheet SS and a largest size sheet LS can be stacked and supported on the tray 12. The trailing edge regulation plate 13 is provided so as to be moved only in the center portion in a width direction of the tray 12 so as not to interrupt the movement of the side regulation plates 14 and 16.

A trailing edge separation portion 18 which regulates the position of the trailing edge which is the upstream edge in a sheet conveying direction of an uppermost sheet Sa is provided on the trailing edge regulation plate 13 so as to be moved in up and down directions. The trailing edge separation portion 18 has a protrusion portion 18D which protrudes from a regulation portion surface 13C of the trailing edge regulation plate 13 illustrated in FIG. 13 and presses the trailing edge of the uppermost sheet Sa from above. As illustrated in FIG. 13, a separation aid sheet 18E made of a material having a high friction coefficient for adding resistance to the upper surface of the stacked sheet is stuck onto the lower surface of the protrusion portion 18D, that is, the sheet abutment surface.

When the uppermost sheet Sa is conveyed by a protrusion length S1 of the protrusion portion 18D illustrated in FIG. 13, the trailing edge separation portion 18 is lowered so as to be abutted on a sheet Sb immediately below the uppermost sheet Sa. The conveyance of the sheet Sb immediately below the uppermost sheet Sa following the uppermost sheet Sa being conveyed can be prevented by a friction force caused by the weight of the trailing edge separation portion 18 thereby preventing the occurrence of the overlap conveyance. The protrusion portion 18D is abutted on the surface of the tray 12 when there are no set sheets.

In FIG. 13, a supporting portion 18A is provided in the trailing edge separation portion 18 and engages an engaging portion 13E provided in the trailing edge regulation plate 13. A ball bearing or a roller with a surface having a low friction resistance is provided in the supporting portion 18A, so that the movement of the trailing edge separation portion 18 in the direction of the arrow G in the drawing can be smooth.

In recent years, the image forming apparatus has been often required to make a booklet. A sheet having a tabbed edge (hereinafter, called a tabbed sheet) as a partitioning sheet can be used. With this, the tabbed sheet need be conveyed from the sheet conveying apparatus. Therefore such sheet conveying apparatus of an air sheet feeding system need to convey the tabbed sheet.

FIG. 15A is a diagram illustrating the state that a tabbed sheet TS of a predetermined size is set in the sheet conveying apparatus of an air sheet feeding system. The tabbed sheet TS is supported on the tray 12 in the state that a tab portion TSa is located upstream in a sheet conveying direction. The side regulation plates 14 are abutted on both side edges of the tabbed sheet TS. The trailing edge regulation plate 13 is abutted on the tab portion TSa of the tabbed sheet TS.

The conveying operation is started in such state. As illustrated in FIG. 15B, air is blown from the loosening nozzle 33 and the separation nozzle 34 to the leading edge of the tabbed sheet TS. The trailing edge regulation plate 13 is provided only in the center portion. Some tabbed sheets TS in which the tab portions TSa are not abutted on the trailing edge regulation plate 13, e.g., the uppermost and second uppermost tabbed sheets TS, are moved rearward by a width TD of the tab portion TSa at the maximum in the direction of the arrow T.

When the tabbed sheet TS in which the tab cannot be regulated by the trailing edge regulation plate 13 is moved rearward, the wind pressure is weakened as the tabbed sheet TS is far away from the loosening nozzle 33. Therefore, as illustrated in FIG. 16, a leading portion TF of the uppermost tabbed sheet TS1 and the second uppermost tabbed sheet TS2 in which the tabs cannot be regulated by the trailing edge regulation plate 13 cannot be sufficiently blown up and is hung down. Air blown from the loosening nozzle 33 is hard to enter into between the sheets, and the leading edge of the sheet cannot be appropriately loosened.

Alternatively, the blowing-up of the sheet is not stable and other sheets are affected so as to be in the unstable blowing-up state. The sheets are repeatedly moved up and down in the direction of the arrow R illustrated in FIG. 16. In such blowing-up state, the disadvantage such as a jam due to overlap conveyance and absorption failure to the absorption conveying belt 21 and sheet corner folding is caused.

The conveyance of the tabbed sheet is also required, not only in the sheet conveying apparatus of an air sheet feeding system, but also in the sheet conveying apparatus which is of a sheet conveying system by a roller and lifts and lowers the tray stacking the sheet by a lifter mechanism.

In the sheet conveying apparatus which conveys the sheet by the roller, as in the sheet conveying apparatus of an air sheet feeding system, the tab cannot be regulated by the trailing edge regulation member and the tabbed sheet may be shifted rearward. When the roller conveying the sheet is arranged at the leading edge of the sheet, the tabbed sheet cannot be conveyed, resulting in the conveying failure of the sheet. When the sheet can be conveyed, the timing to convey the sheet is largely shifted. Therefore, the sheet interval may be increased to lower the productivity and a delay jam may be detected.

To address such disadvantage, it is considered that a tab guide only for the tabbed sheet which is abutted on all the tab portions TSa of the tabbed sheets TS is attached as an option (see JP-A No. 2000-229732 and U.S. Pat. No. 7,290,764).

FIG. 17 is a diagram illustrating the state that a tab guide 13M is provided on the upper surface of the tray 12. The tab guide 13M is provided on the upper surface of the tray 12 so that the trailing edge position of the tabbed sheet TS can be regulated, and the tabbed sheet TS can be reliably conveyed.

In such related art sheet conveying apparatus and the image forming apparatus having the same, the tab guide should be attached to the upper surface of the tray. This is because when the tab guide 13M illustrated in FIG. 17 is provided, the region indicated by the slant lines of the tab guide 13M is overlapped with the tray 12 and thereby the tab guide 13M cannot be fixed to the storage case 11. The tab guide abutted on all the tab portions TSa of the tabbed sheets TS should be attached to the upper surface of the tray 12.

As illustrated in FIG. 18, the tabbed sheet TS is conveyed. As the remaining amount of the tabbed sheets TS is decreased, the tray 12 is lifted and the tab guide 13M is lifted together with the tray 12. In order that the lifted tab guide 13M cannot collide with a component 40 configuring the image forming apparatus body, the tab guide 13M need be low.

As illustrated in FIG. 19, the tab guide 13M is set to be low, the height which can guide the tabbed sheet TS is decreased accordingly. The amount of the tabbed sheets TS stacked is greatly reduced. As a result, the number of feedings of the tabbed sheet TS is increased, and the operability and productivity of the apparatus are very low.

The present invention provides a sheet conveying apparatus and an image forming apparatus which can obtain high operability and productivity when a tabbed sheet is conveyed.

SUMMARY OF THE INVENTION

The present invention provides a sheet conveying apparatus including: a tray provided in a sheet storage portion so as to be lifted and lowered; a sheet conveying portion which conveys the uppermost one of sheets supported on the tray at a predetermined conveying height position; a regulation portion which is provided in the sheet storage portion and regulates the position of the sheet supported on the tray; and a tabbed sheet regulation unit which is provided in the regulation portion and has a tab portion regulation portion which is abutted on a tab portion of a tabbed sheet to regulate the position of the tabbed sheet when the tabbed sheet is stacked on the tray, wherein the tab portion regulation portion is movably provided in the tabbed sheet regulation unit so as to be moved when the tray is lifted and abutted against the tab portion regulation portion.

According to the present invention, the tabbed sheet regulation unit having the tab portion regulation portion moved with the lifting of the tray is provided at the upper end of the regulation portion, and thereby the amount of the tabbed sheets stacked can be increased. Further, high operability and productivity can be obtained when the tabbed sheet is conveyed.

Further features of the present invention will become apparent from the following description of exemplary embodiments with reference to the attached drawings.

DESCRIPTION OF THE EMBODIMENTS

An exemplary embodiment for carrying out the present invention will be described below in detail with reference to the drawings.

Figure 1:
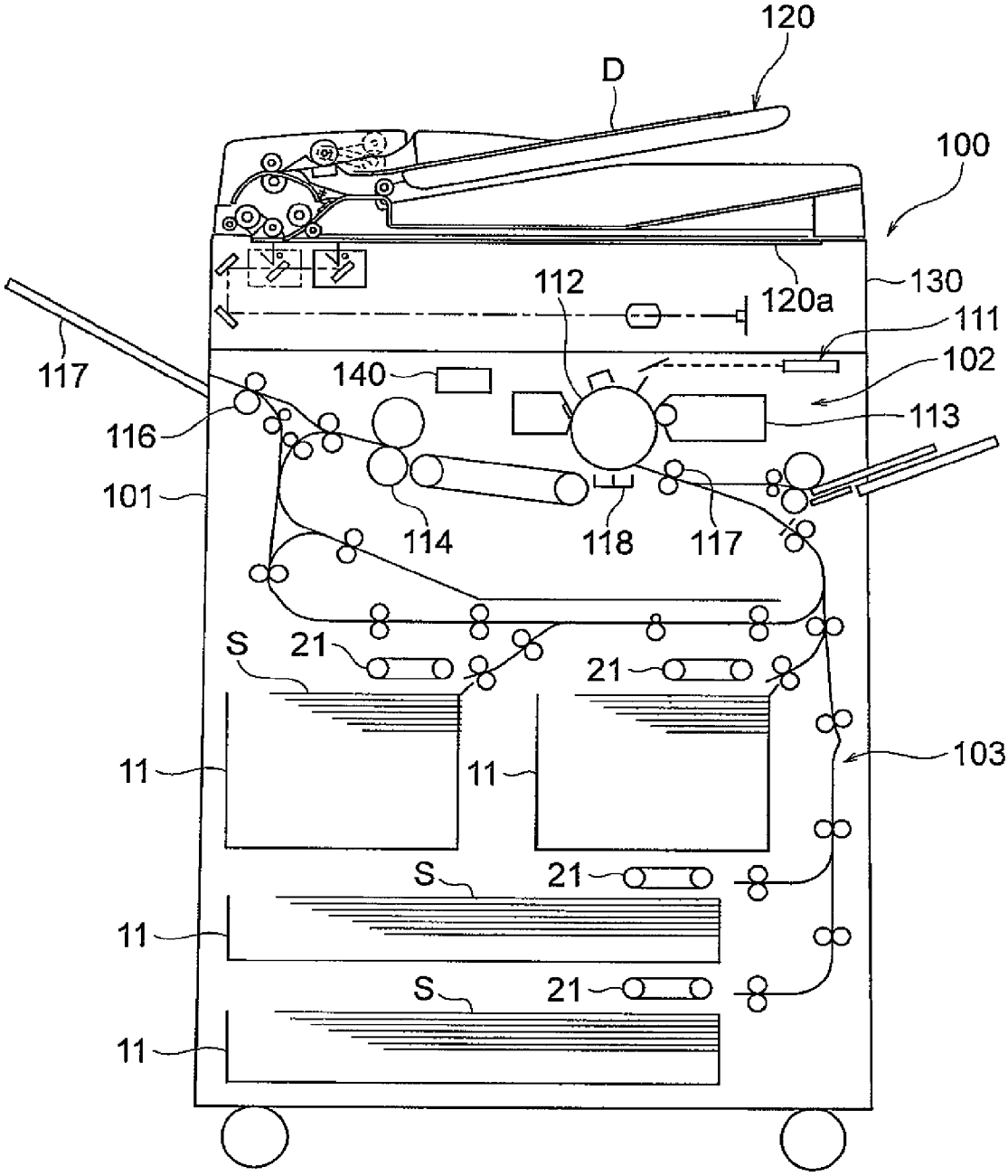
FIG. 1 is a diagram illustrating the schematic configuration of a printer which is an example of an image forming apparatus having a sheet conveying apparatus according to an embodiment of the present invention.

FIG. 1 is a diagram illustrating the schematic configuration of a printer which is an example of an image forming apparatus having a sheet conveying apparatus according to an embodiment of the present invention.

FIG. 1 illustrates a printer 100 and a printer body 101. An image reading portion 130 which reads an original D placed on a platen glass 120*a* as an original placing platen by an automatic original conveying apparatus 120 is provided in the upper portion of the printer body 101. An image forming portion 102 and a sheet conveying apparatus 103 which conveys a sheet S to the image forming portion 102 are provided below the image reading portion 130.

The image forming portion 102 has a photosensitive drum 112, a development device 113, and a laser beam scanner unit 111. The sheet conveying apparatus 103 has plural sheet storage cases 11 which store the sheet S such as OHT and is detachably attached to the printer body 101, and a conveying absorption belt 21 which is a conveying belt as an example of a sheet conveying unit conveying the sheet S stored in the sheet storage case 11. In FIG. 1, a controller 140 controls the image forming operation and the sheet conveying operation of the printer 100.

Next, the image forming operation of the printer 100 of such configuration will be described.

When an image reading signal is output from the controller, not illustrated, provided in the printer body 101 to the image reading portion 130, an image is read by the image reading portion 130. The laser beam scanner unit 111 irradiates the photosensitive drum 112 with a laser beam corresponding to the electric signal.

The photosensitive drum 112 is previously charged. An electrostatic latent image is formed by the light irradiation. The electrostatic latent image is developed by the development device 113 to form a toner image on the photosensitive drum.

When a sheet feeding signal is output from the controller to the sheet conveying apparatus 103, the sheet S is fed from the sheet storage case 11 which is a sheet storage portion. The conveyed sheet S is conveyed to a transfer portion configured by the photosensitive drum 112 and a transfer charger 118 in synchronization with the toner image on the photosensitive drum by a registration roller 117.

The toner image is transferred to the sheet conveyed to the transfer portion. The sheet is then conveyed to a fixing portion 114. An unfixed transfer image is permanently fixed onto the sheet S by being heated and pressed by the fixing portion 114. The sheet onto which the image is fixed is discharged by a discharge roller 116 from the printer body 101 to the discharge tray 117.

Figure 2:
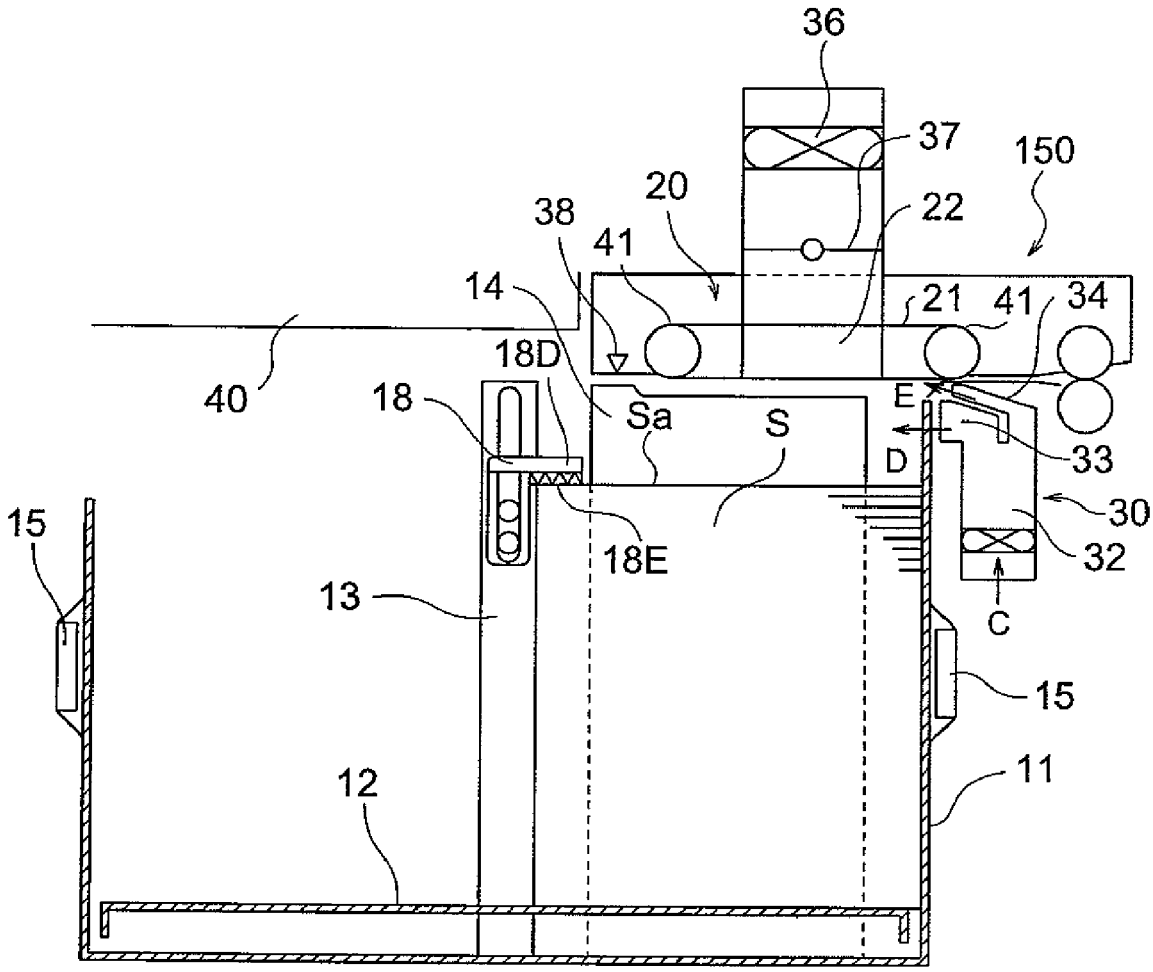
FIG. 2 is a diagram illustrating the configuration of the sheet conveying apparatus.

FIG. 2 is a diagram illustrating the configuration of the sheet conveying apparatus 103.

The sheet storage case 11 as the sheet storage portion has a tray 12 which stacks and supports plural sheets and is lifted and lowered according to the amount of sheets stacked, a trailing edge regulation plate 13 which regulates the trailing edge of the sheet S, and a side regulation plate 14 which regulates the position of the sheet S in a width direction. The trailing edge regulation plate 13 and the side regulation plate 14 which are a regulation portion abutted on the sheet to regulate the position of the sheet arbitrarily change the position of the sheet stored according to size.

The tray 12 is provided so as to be lifted and lowered by the driving unit, not illustrated. The driving unit is controlled so that the tray 12 can be lifted when the amount of sheets stacked is reduced and be lowered when there are no sheets. The sheet storage case 11 can be drawn out from the printer body 101 by a slide rail 15.

A sheet conveying mechanism (hereinafter, called an air sheet feeding mechanism) 150 configuring the sheet conveying portion of an air sheet feeding system which separates and conveys each of the sheets on the tray is arranged above the sheet storage case 11. The air sheet feeding mechanism 150 has an absorption conveying portion 20 which absorbs and conveys the sheet S stacked on the tray 12, and an air blowing portion 30 which blows up the upper portion of the sheet bundle on the tray and separates each of the sheets S.

The absorption conveying portion 20 has the absorption conveying belt 21 which is entrained onto a belt drive roller 41 and absorbs the sheet S to convey it in a right direction in the drawing, and an absorption fan 36 which causes a negative pressure for absorbing the sheet S to the absorption conveying belt 21. The absorption conveying portion 20 has a suction duct 22 which is arranged inside the absorption conveying belt 21 and takes in air through the suction hole, not illustrated, formed in the absorption conveying belt 21.

The absorption conveying portion 20 has an absorption shutter 37 which is arranged between the absorption fan 36 and the suction duct 22 and turns on and off the absorption operation of the absorption conveying belt 21. In this embodiment, plural absorption conveying belts 21 are arranged at a predetermined interval in a width direction.

The air blowing portion 30 has a loosening nozzle 33 and a separation nozzle 34 which blow air to the upper portion of the stored sheets S, a separation fan 31, and a separation duct 32 which sends air from the separation fan 31 to the nozzles 33 and 34.

Part of air taken in the direction of the arrow C by the separation fan 31 passes through the separation duct 32, is blown in the direction of the arrow D by the loosening nozzle 33, and blows up several sheets of the upper portion of the sheets S supported on the tray 12. Other air is blown in the direction of the arrow E by the separation nozzle 34 and separates each of the sheets blown up by the loosening nozzle 33 to absorb the sheet to the absorption conveying belt 21.

A sheet surface detection sensor 38 which detects the position of the uppermost surface of the sheets stacked on the tray 12 is arranged upstream of the absorption conveying belt 21. When the lifting and lowering of the tray 12 are controlled based on the detection of the sheet surface detection sensor 38. When the position of the uppermost surface of the sheets is located in an optimal position, the sheet is conveyed.

The sheet presence/absence detection sensor, not illustrated, is provided adjacent the sheet surface detection sensor 38. When there are no sheets on the tray 12, the flag, not illustrated, configuring the presence/absence detection sensor enters into the opening, not illustrated, formed in the tray 12. Thus, the presence/absence detection sensor detects the absence of the sheets.

As illustrated in FIG. 2, the trailing edge separation portion 18 is provided in the trailing edge regulation plate 13 so as to be moved in up and down directions. The trailing edge separation portion 18 is a separation portion which presses the trailing edge as an upstream edge in a sheet conveying direction of an uppermost sheet Sa from above to regulate the trailing edge position of the sheet for separating the sheet S. The trailing edge separation portion 18 has a protrusion portion 18D which presses the trailing edge of the uppermost sheet Sa from above. A separation aid sheet 18E as a separation member made of a material having a high friction coefficient for adding resistance to the upper surface of the stacked sheet is stuck onto the lower surface of the protrusion portion 18D, that is, the sheet abutment surface.

The uppermost sheet Sa is conveyed by a protrusion length S1 of the protrusion portion 18D illustrated in FIG. 5, as will be described later. The trailing edge separation portion 18 is lowered so as to be abutted on a sheet immediately below the uppermost sheet Sa. The overlap conveyance in which the sheet immediately below the uppermost sheet Sa is conveyed so as to follow the uppermost sheet Sa being conveyed can be prevented by a friction force caused by the weight of the trailing edge separation portion 18. Engaging portions 18A and 18B illustrated in FIG. 9, as will be described later, are protruded on both sides in a width direction perpendicular to a sheet conveying direction at the upper end of the trailing edge separation portion 18.

The sheet conveying operation of the sheet conveying apparatus 103 (the air sheet feeding mechanism 150) will be described.

Figure 3:
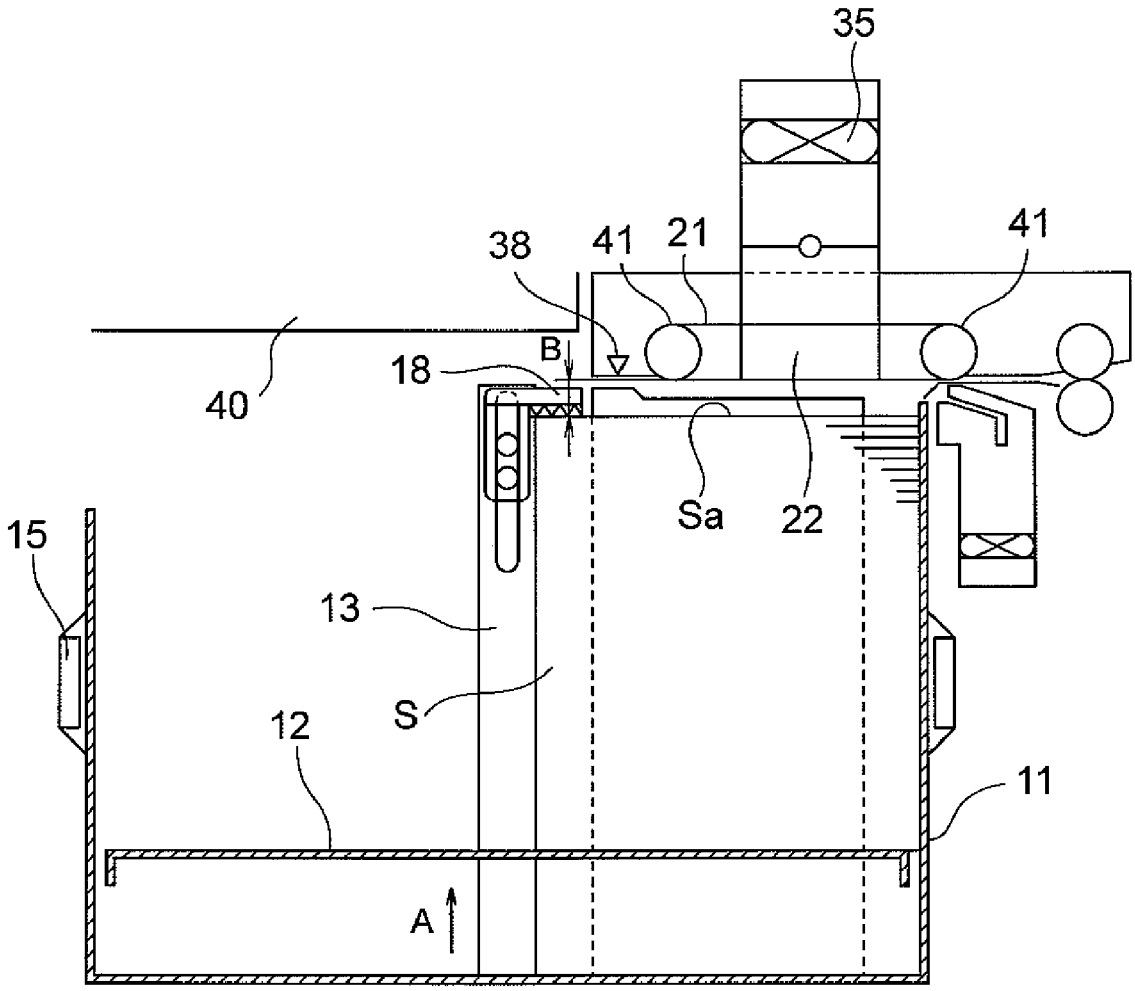
FIG. 3 is a first diagram describing the sheet conveying operation of the sheet conveying apparatus.

A user draws out the sheet storage case 11, sets the sheet S on the tray 12, and stores the sheet in a predetermined position, as illustrated in FIG. 2. As illustrated in FIG. 3, the tray 12 starts to be lifted in the direction of the arrow A by the driving unit, not illustrated. When the tray 12 reaches a conveyable position where the distance between the uppermost sheet Sa on the tray 12 and the absorption conveying belt 21 is B, the controller 140 stops the tray 12 in this position. The controller 140 waits for a sheet conveying signal for starting conveyance.

Figure 4A:
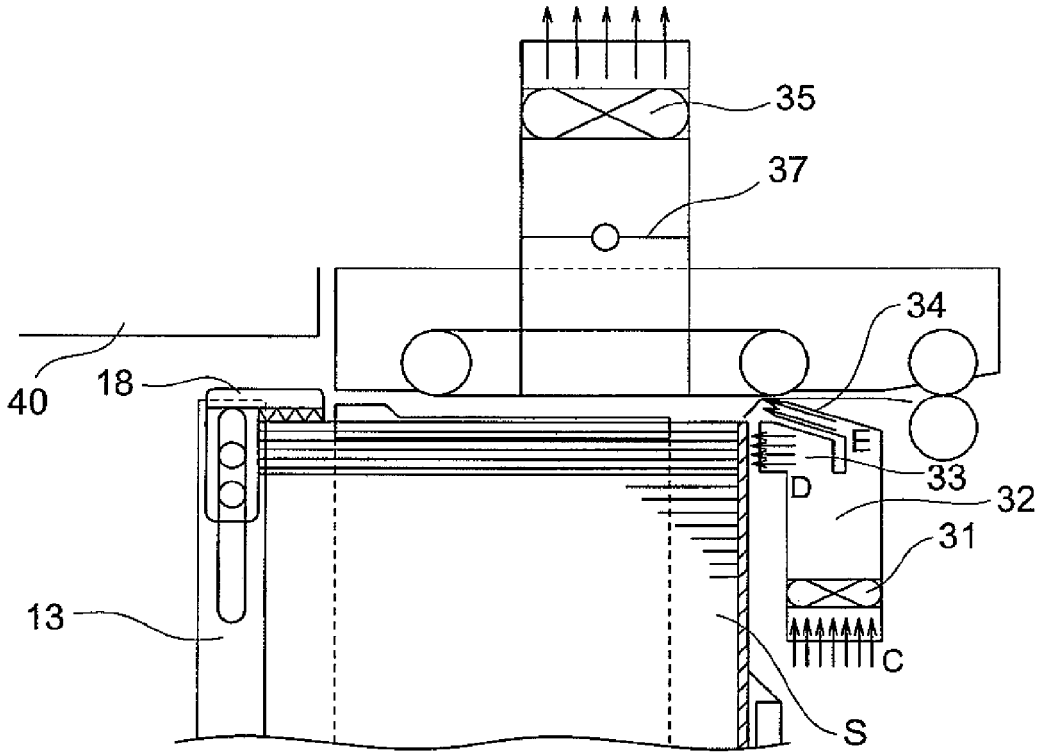
FIGS. 4A and 4B are second diagrams describing the sheet conveying operation of the sheet conveying apparatus.

Upon the detection of the sheet conveying signal, the controller 140 operates the separation fan 31. As illustrated in FIG. 4A, air is taken in the direction of the arrow C. The air is blown to the sheet S on the tray 12 from the directions of the arrows D and E by the loosening nozzle 33 and the separation nozzle 34 via the separation duct 32. The several upper sheets S are blown up.

The controller 140 operates the absorption fan 36 to discharge air in the direction of the arrow F. In this time the absorption shutter 37 is still closed. The lifting and lowering of the tray 12 are controlled based on the detection of the sheet surface detection sensor 38. When the uppermost surface of the sheets is located in the optimal predetermined conveying height position, the tray 12 is stopped.

Figure 4B:
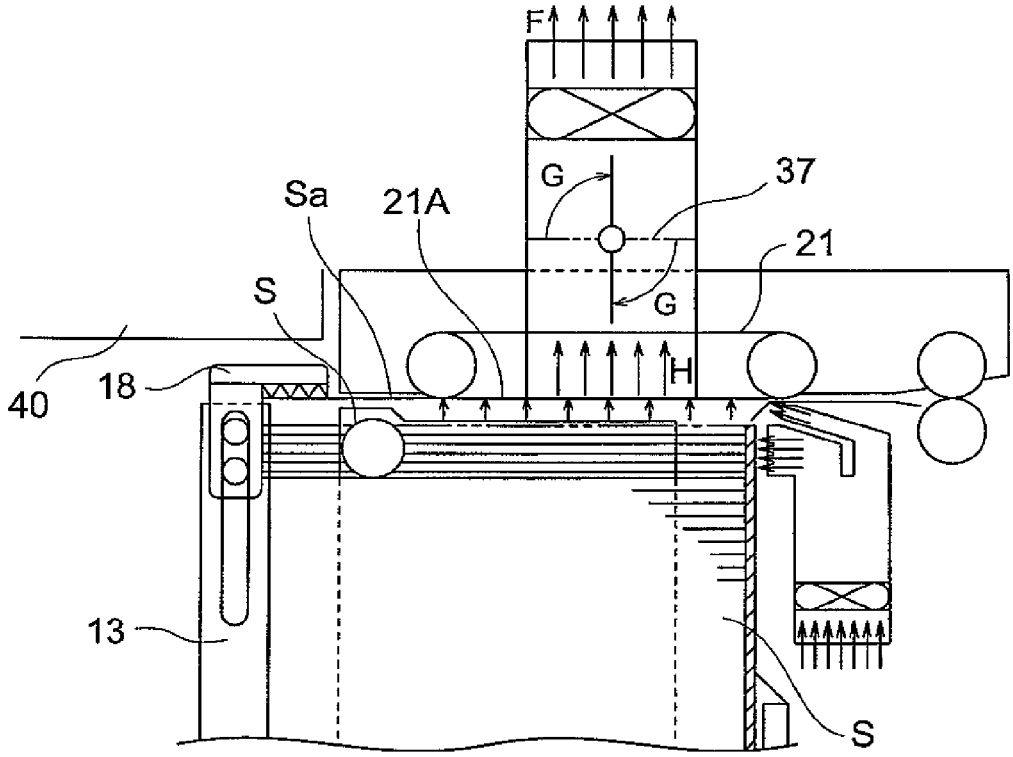

A predetermined time is elapsed after the detection of the conveying signal. When the blowing-up of plural upper sheets SA is stable, the controller 140 rotates the absorption shutter 37 in the direction of the arrow G as illustrated in FIG. 4B. In this manner, a suction force from the suction hole provided in the absorption conveying belt 21 in the direction of the arrow H occurs. The uppermost sheet Sa of the plural sheets SA during blowing-up is lifted from the position indicated by the two-dot chain line in the drawing by the separation air from the separation nozzle 34 and the suction force (absorption force), and is then absorbed to a lower surface 21A of the absorption conveying belt 21.

Figure 5:
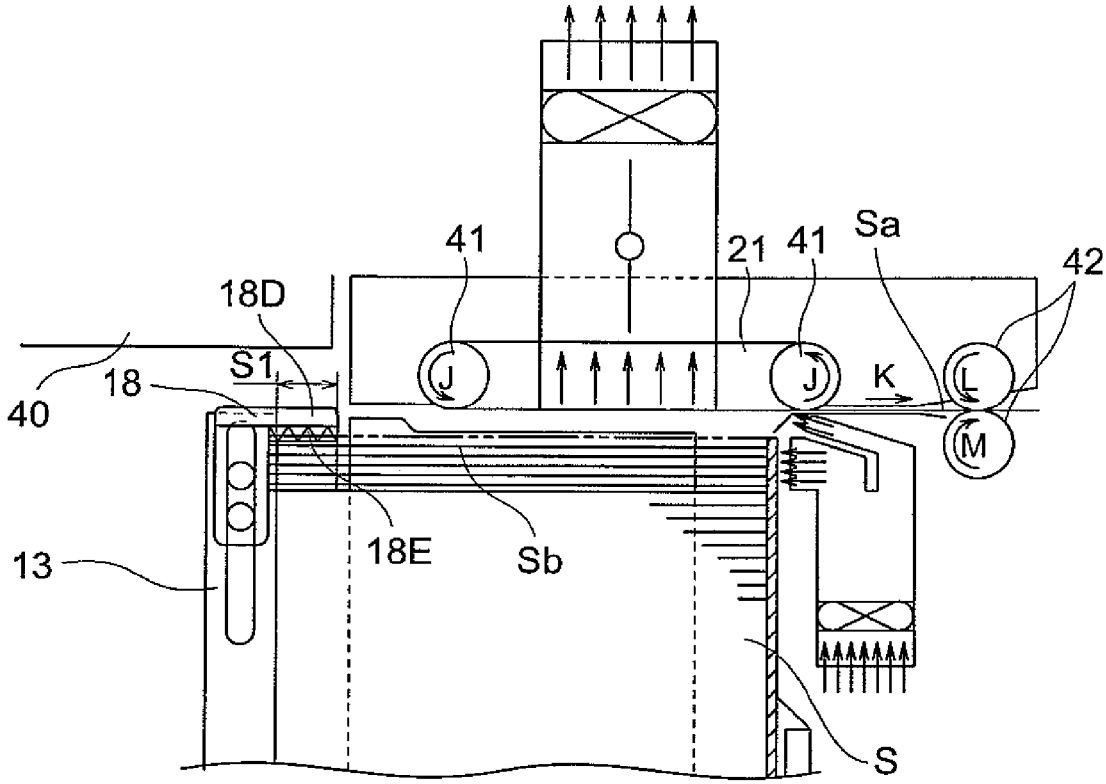
FIG. 5 is a third diagram describing the sheet conveying operation of the sheet conveying apparatus.

Next, in FIG. 5, the belt drive roller 41 is rotated in the direction of the arrow J. The uppermost sheet Sa absorbed to the absorption conveying belt 21 is conveyed in the direction of the arrow K and is then conveyed to an image forming portion by a pair of pullout rollers 42 rotated in the directions of the arrows L and M.

When the uppermost sheet Sa is conveyed in this manner, the trailing edge of the uppermost sheet Sa is pressed by the protrusion portion 18D of the trailing edge separation portion 18 in which the separation aid sheet 18E is stuck onto the sheet abutment surface. The uppermost sheet Sa is conveyed by the protrusion length S1 of the protrusion portion 18D. Then the trailing edge separation portion 18 is lowered and is then abutted on a sheet Sb immediately below the uppermost sheet Sa. The overlap conveyance of the sheet Sb immediately below the uppermost sheet Sa being conveyed can be prevented.

Figure 6A:
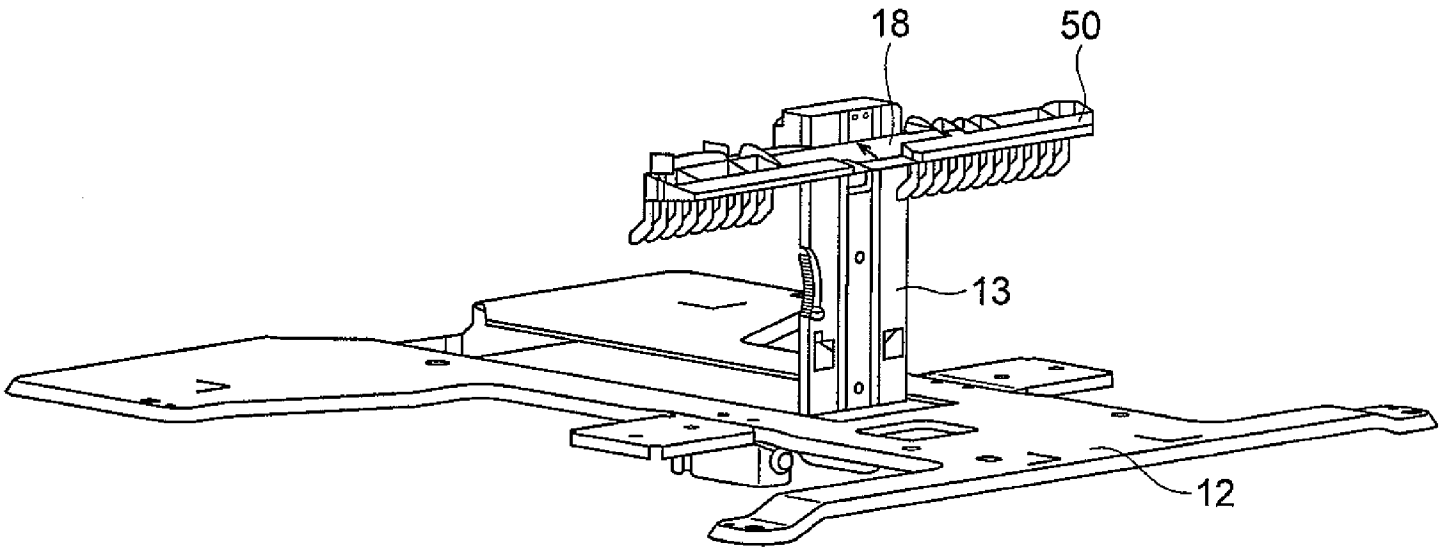
FIGS. 6A and 6B are diagrams illustrating the state that a tabbed sheet regulation unit is set to a trailing edge separation portion provided in a trailing edge regulation plate of the sheet conveying apparatus.
Figure 6B:
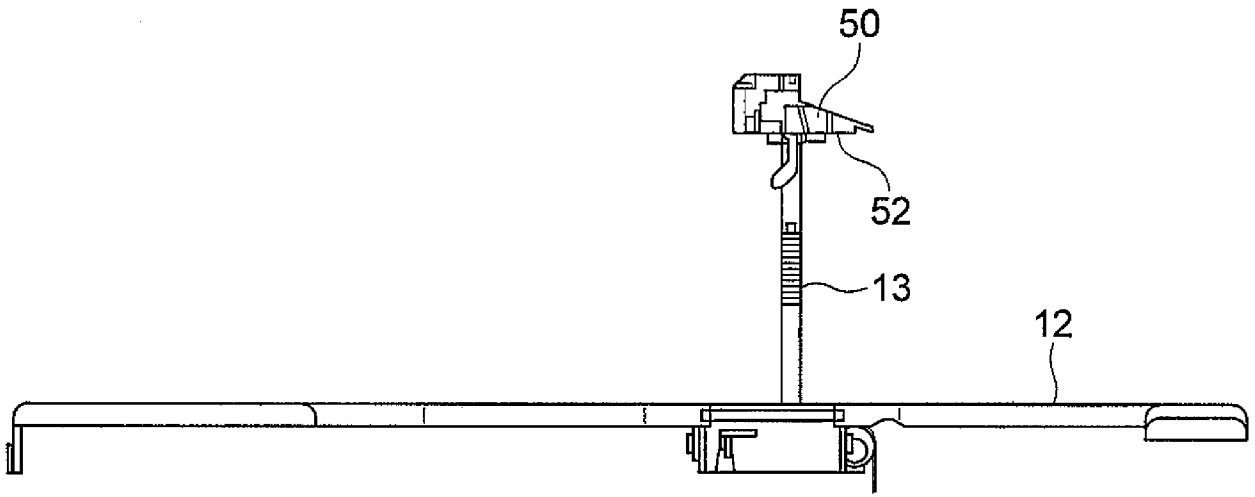

In this embodiment, as illustrated in FIGS. 6A and 6B, a tabbed sheet regulation unit 50 is detachably attached to the trailing edge regulation plate 13 via the trailing edge separation portion 18.

Figure 7:
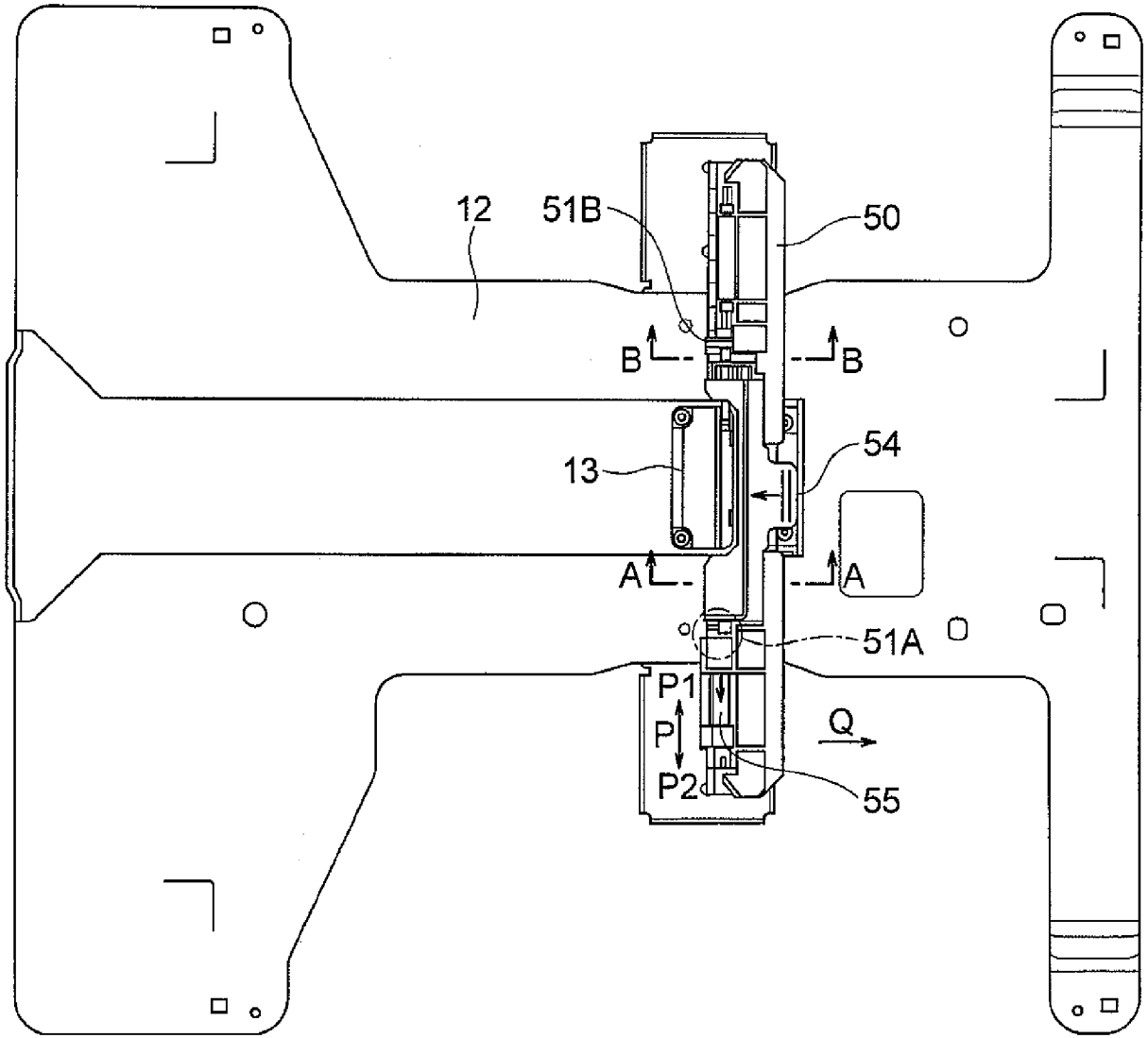
FIG. 7 is a first diagram describing the configuration of the tabbed sheet regulation unit.
Figure 8A:
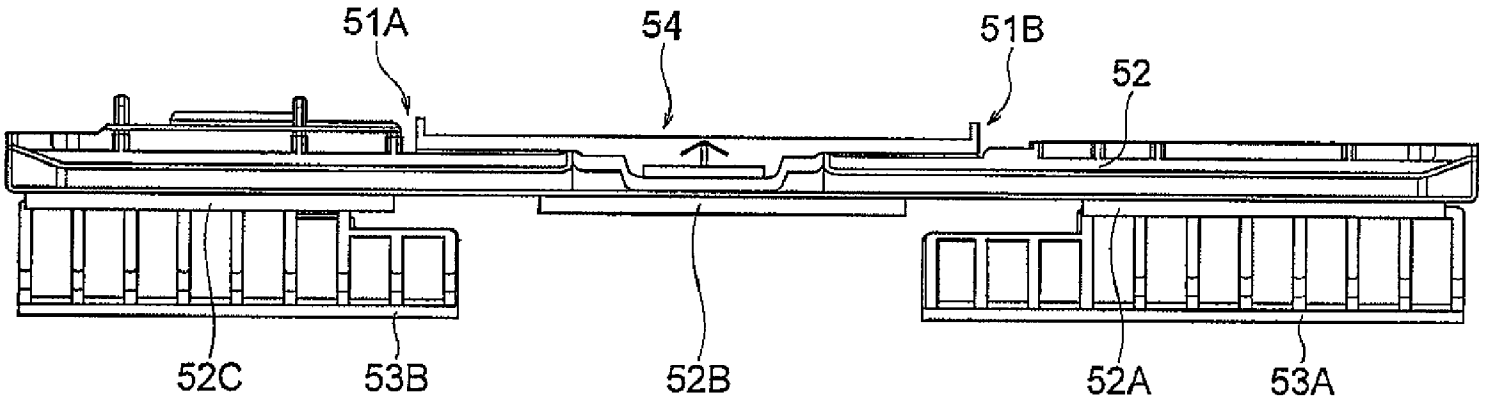
FIGS. 8A and 8B are second diagrams describing the configuration of the tabbed sheet regulation unit.
Figure 8B:
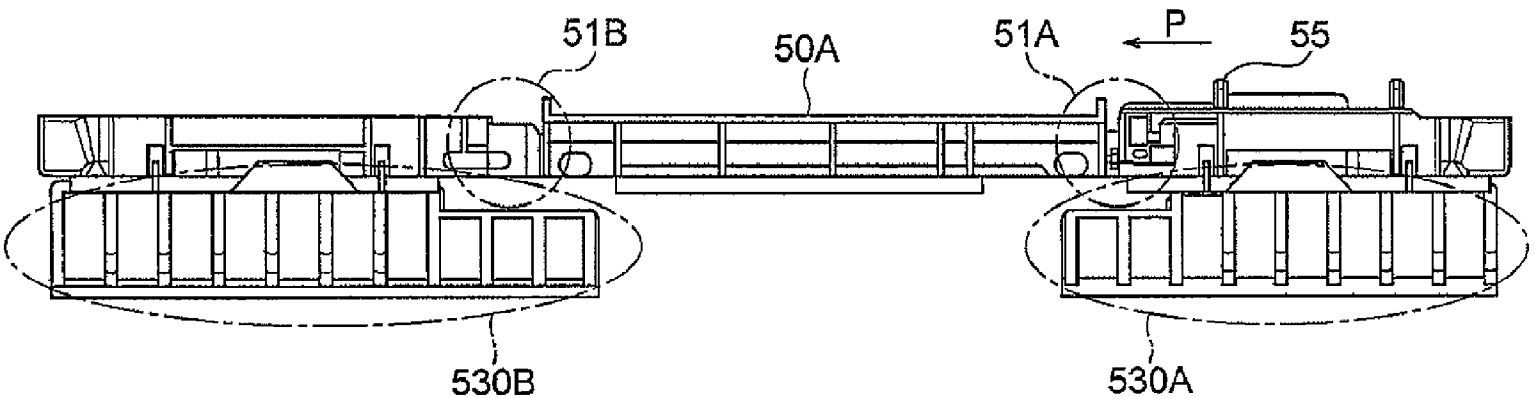

As illustrated in FIG. 7 as a top view, FIG. 8A as a front view, and FIG. 8B as a rear view, the tabbed sheet regulation unit 50 has a front engaging portion 51A and a rear engaging portion 51B which attach the tabbed sheet regulation unit 50 to the trailing edge regulation plate 13. The tabbed sheet regulation unit (hereinafter, called a regulation unit) 50 has a sheet abutting portion 52 which is abutted on the trailing edge of the tabbed sheet (or a tab portion) from above.

The regulation unit 50 has a front tab portion regulation portion 53A and a rear tab portion regulation portion 53B which are abutted on the tab portion of the tabbed sheet and are rotatably provided in a regulation unit body 50A. The tab portion regulation portions 53A and 53B are abutted on the tab portion of the tabbed sheet which is stacked and supported on the tray 12 and is formed in the position where the tab portion of the tabbed sheet is not abutted on the trailing edge regulation plate 13, and regulate the position of the tabbed sheet. The tab portion regulation portions 53A and 53B are provided so that the position of some of the tabbed sheets stacked and supported on the tray 12 which can be lifted and lowered can be regulated by the trailing edge regulation plate 13 and others can be regulated by the tab portion regulation portions 53A and 53B.

In this embodiment, as in the trailing edge separation portion 18, separation aid sheets 52A to 52C are stuck onto the sheet abutment surface of the sheet abutting portion 52 which is abutted on the trailing edge of the tabbed sheet (or the tab portion) from above to prevent the following overlap conveyance of all the tabbed sheets. In this embodiment, the regulation unit 50 is attached to the trailing edge separation portion 18 in the portion other than the region in which the separation aid sheet 18E of the trailing edge separation portion 18 is provided. Therefore, the separation performance of the trailing edge separation portion 18 cannot be deteriorated.

Figure 9:
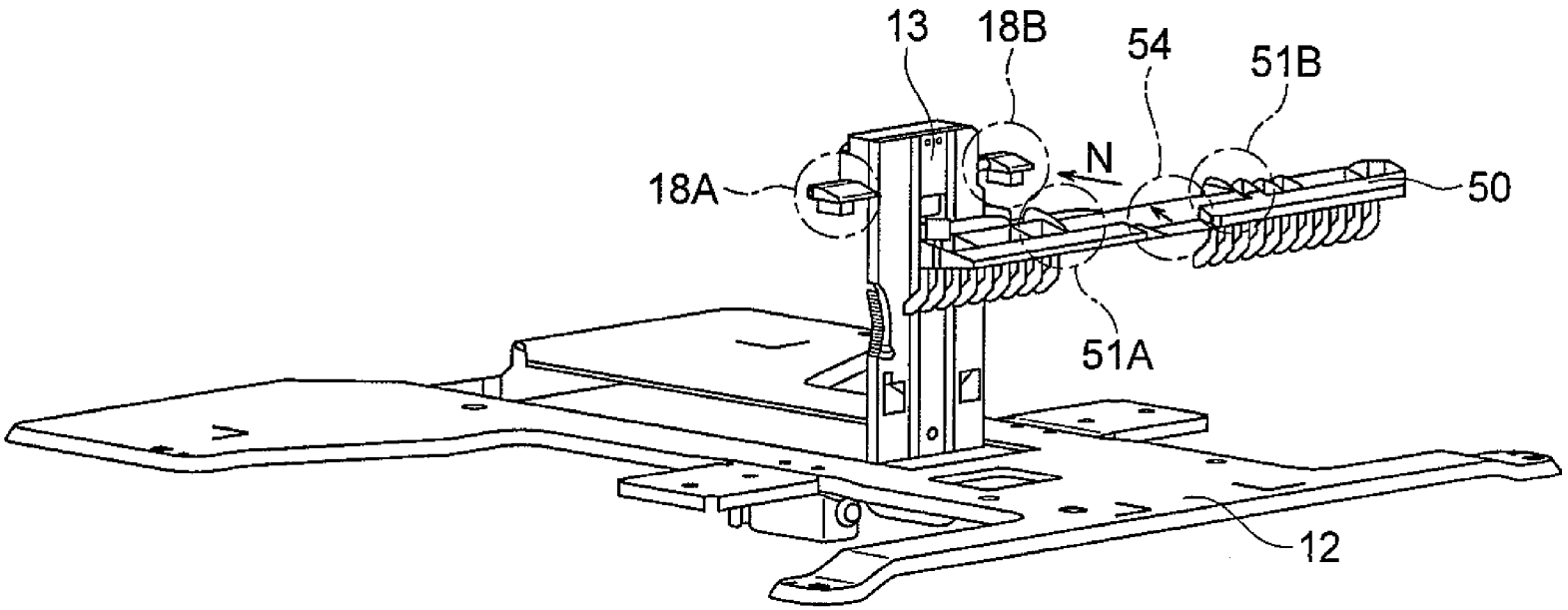
FIG. 9 is a diagram illustrating the state that the tabbed sheet regulation unit is being set.

FIG. 9 is a diagram illustrating the state that the user is setting the regulation unit 50 to the trailing edge separation portion 18. A handle portion 54 provided in the center portion of the regulation unit 50 illustrated in FIG. 9 is held to move the regulation unit 50 in the direction of the arrow N. By doing so, as illustrated in FIG. 10A as a cross-sectional view taken along line A-A of FIG. 7, the engaging portions 51A and 51B of the regulation unit 50 engage the engaging portions 18A and 18B provided at both ends of the upper portion of the trailing edge separation portion 18 illustrated in FIG. 9.

Figure 10A:
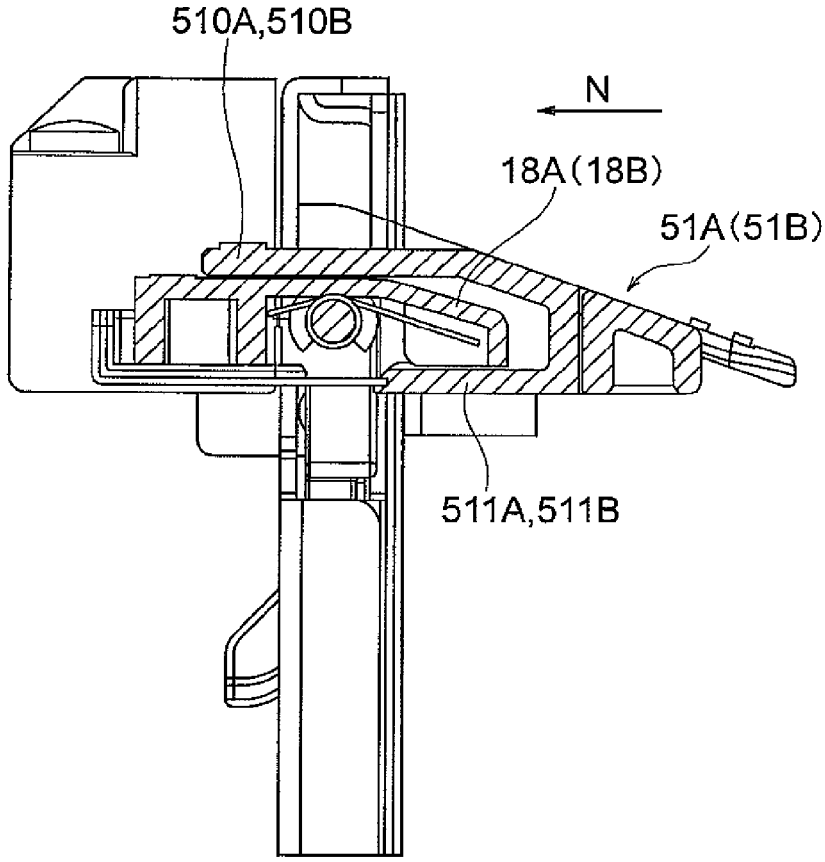
FIGS. 10A and 10B are cross-sectional views illustrating the state that the tabbed sheet regulation unit is set.
Figure 10B:
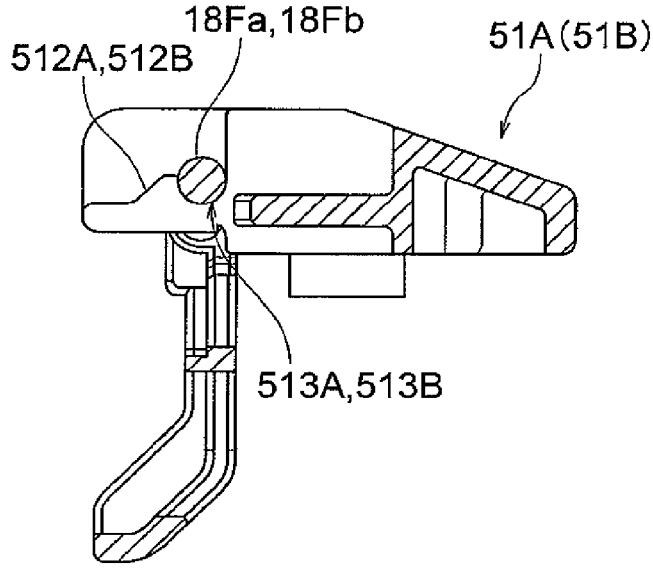

When the regulation unit 50 is engaged to the trailing edge separation portion 18, as illustrated in FIG. 10B as a cross-sectional view taken along line B-B of FIG. 7, the regulation unit 50 is engaged by locking portions 18Fa and 18Fb of the trailing edge separation portion 18.

FIG. 10A illustrates upper surface engaging portions 510A and 510B of the engaging portions 51A and 51B of the regulation unit 50 and lower surface engaging portions 511A and 511B of the engaging portions 51A and 51B of the regulation unit 50. FIG. 10B illustrates inclined surface portions 512A and 512B provided in the engaging portion of the regulation unit 50, and groove portions 513A and 513B provided in the engaging portion of the regulation unit 50.

At the time of the setting of the regulation unit 50, the regulation unit 50 is inserted in the direction of the arrow N, as already described, while the upper surface engaging portions 510A and 510B of the regulation unit 50 are matched with the protrusion portion 18D of the trailing edge separation portion 18. By doing so, the lower surface engaging portions 511A and 511B engage the inserted regulation unit 50. Finally, the locking portions 18Fa and 18Fb of the trailing edge separation portion attempt to ascend the inclined surface portions 512A and 512B of the regulation unit 50.

When the regulation unit 50 is further inserted, the upper surface engaging portions 510A and 510B are slightly flexed and the locking portions 18Fa and 18Fb fall in the groove portions 513A and 513B. The setting of the regulation unit 50 is completed. When the setting of the regulation unit 50 is completed, the regulation unit 50 is held to the trailing edge separation portion 18 via the locking portions 18Fa and 18Fb in the state that the tab portion regulation portions 53A and 53B can be rotated.

When the setting of the regulation unit 50 is completed, the regulation unit 50 is locked by a knob 55 which is provided in the one engaging portion 51A and is slidable in the direction of the arrow P, as illustrated in FIG. 7. The knob 55 is typically locked by engaging the locking portion, not illustrated, provided in the engaging portion 18A of the trailing edge separation portion 18 while being pressed in the direction of the arrow P1 holding the setting. When the regulation unit 50 is detached, the knob 55 is slid in the direction of the arrow P2 to release the lock between the knob 55 and the locking portion, not illustrated. Then, the regulation unit 50 can be detached by being moved in the direction of the arrow Q.

Figure 16:
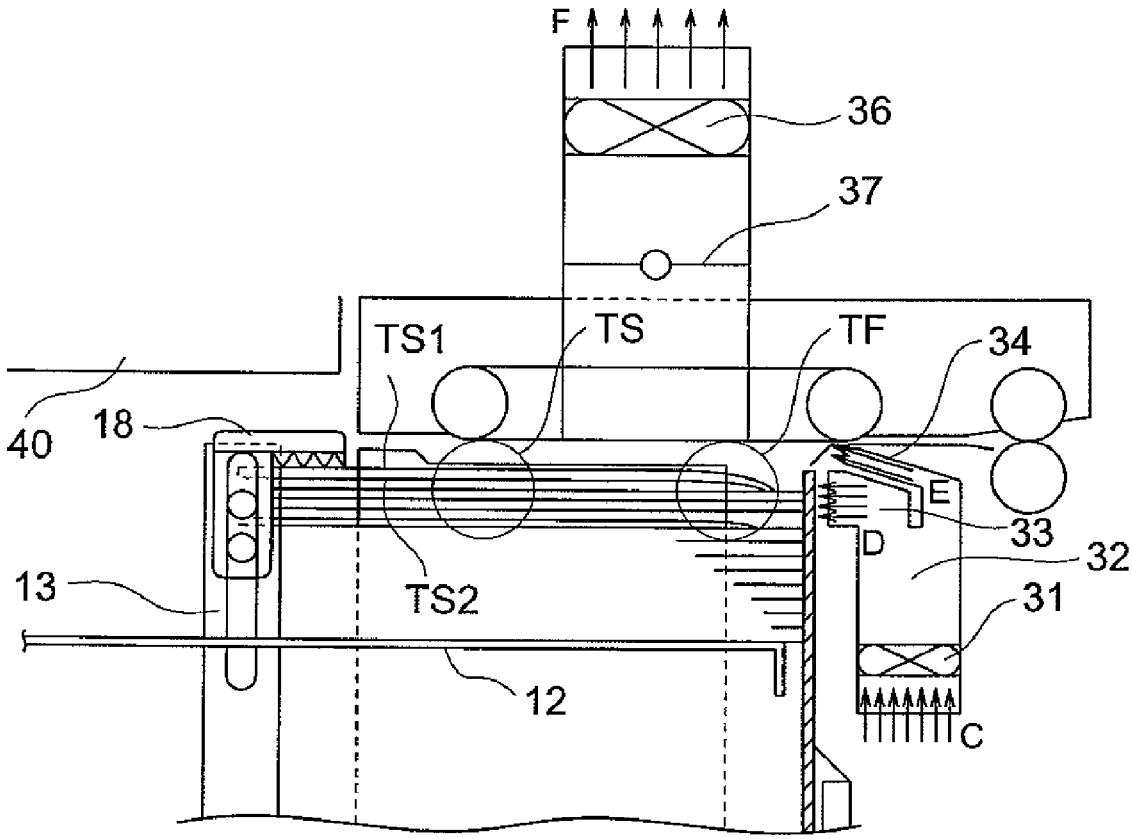
FIG. 16 PRIOR ART
FIG. 16 is a side view illustrating the state that the tabbed sheet of the related art sheet conveying apparatus is conveyed.
Figure 17:
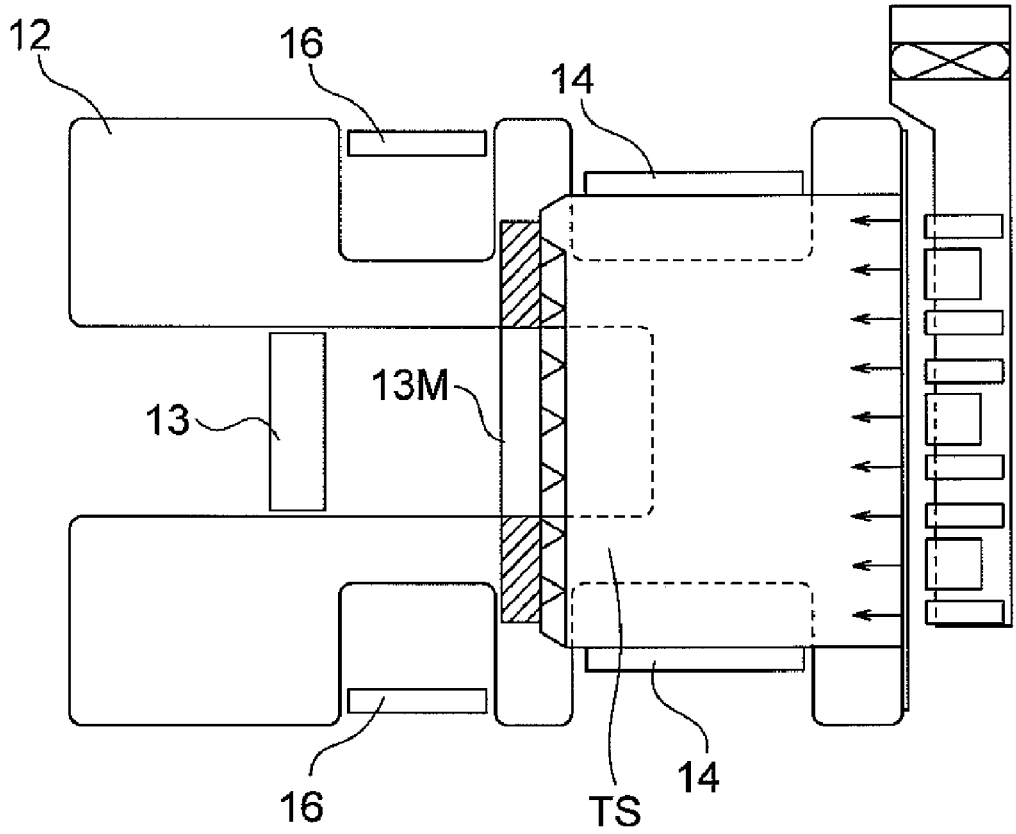
FIG. 17 PRIOR ART
FIG. 17 is a plan view illustrating the state that a tab guide of the storage case of the related art sheet conveying apparatus is attached.

The tab portion regulation portions 53A and 53B of the regulation portion 50 have a length in up and down direction indicated by the H2 illustrated in 11A. The portion indicated by the H1 corresponds to the plural tabbed sheets TS being blown-up illustrated in FIG. 16. The tab portion regulation portions 53A and 53B have a regulation portion indicated by the H1 so that the tabbed sheet being blown-up as illustrated in FIG. 16 can be prevented from moving to the upstream in a conveying direction. This can prevent the disturbance of the blowing-up state and thus the occurrence of conveyance failure.

The tab portion regulation portions 53A and 53B are rotatably supported by the regulation unit body 50A, as already described. Typically, a sheet presence/absence detection unit, not illustrated, detects that there is no tabbed sheets and the conveyance of the tabbed sheet is completed. The tray 12 is controlled so as to start to be lowered by a control unit, not illustrated.

When there is caused a disadvantage in the detecting unit and the control unit, the tray 12 may continue to be lifted. Typically, the tray 12 which starts to be lowered in the position where the distance between the trailing edge separation portions 18A and 18B and the upper component 40 is J1 continues to be lifted, and thereby the trailing edge separation portions 18A and 18B are lifted together with the tray 12 and reach the position where the distance between the trailing edge separation portions 18A and 18B and the upper component 40 is J2.

When the trailing edge separation portions 18A and 18B reach this position, the trailing edge separation plate 13, the trailing edge separation portion 18A or 18B, or part of other apparatuses is damaged. To prevent this, the tray sensor, not illustrated, detecting the position of the tray 12 is provided to detect the position of the tray 12. The safety device, not illustrated, is operated to forcefully lower the tray 12.

Figure 11A:
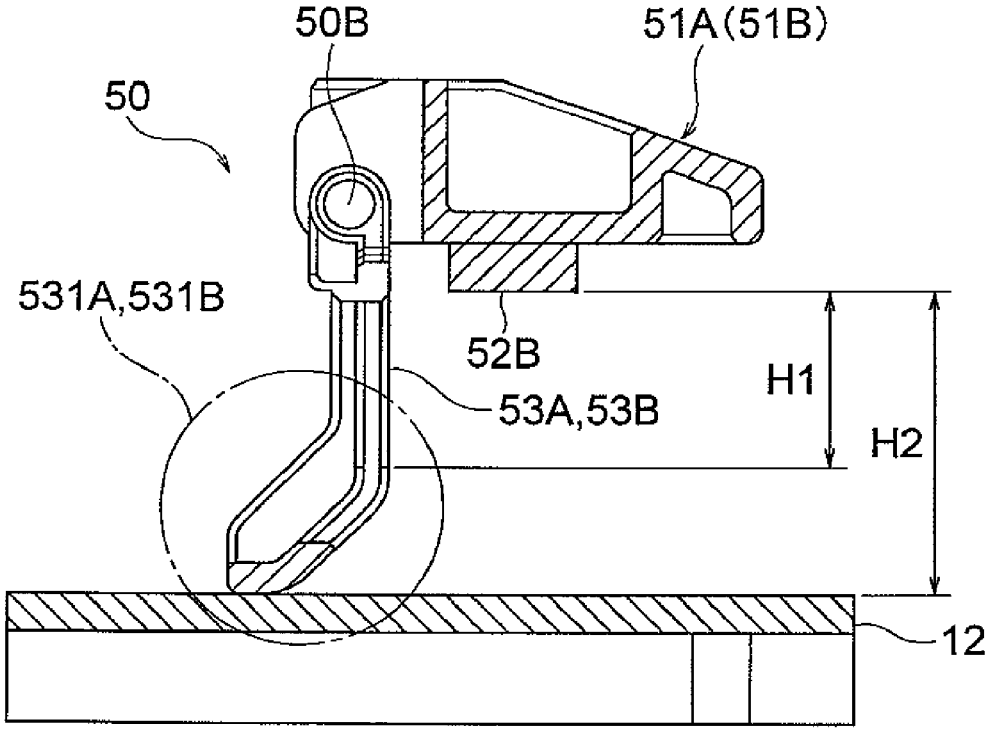
FIGS. 11A and 11B are diagrams describing the operation of a tab portion regulation portion provided in the tabbed sheet regulation unit.

In such configuration, however, when the regulation unit 50 is attached to the trailing edge separation portion 18, as illustrated in FIG. 11A, the final contact point of the regulation unit 50 with the tray 12 is lower by the distance H2 as compared with the case that the regulation unit 50 is not attached. In this case, when the tray 12 continues to be lifted, the upper surface of the regulation unit 50 reaches the dangerous region of the apparatus damage before the tray sensor detects the tray 12. The safety device is useless.

To eliminate the disadvantage, a detecting unit which detects that the regulation unit is attached to the trailing edge separation portion may be provided to accurately grasp the position of the tray, and only when the regulation unit is attached, the control position forcefully lowering the tray may be changed. In such configuration, the configuration becomes complicated and the apparatus becomes expensive.

Figure 18:
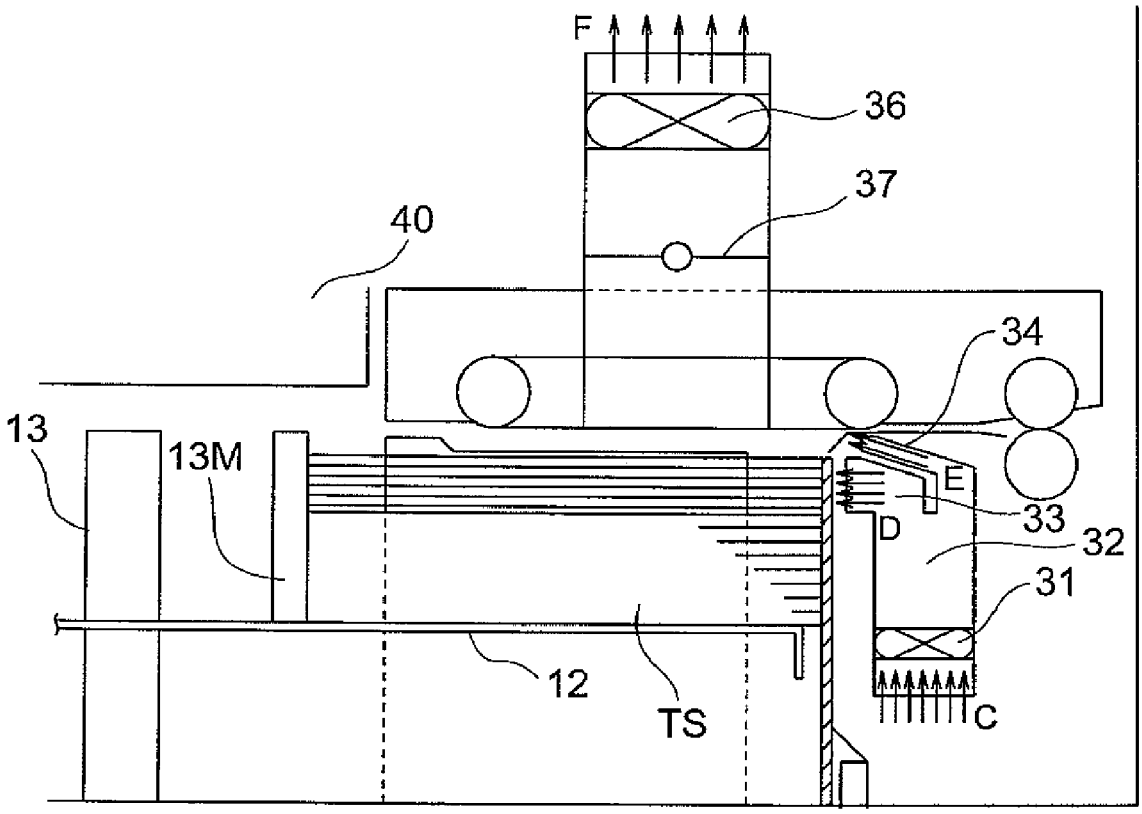
FIG. 18 PRIOR ART
FIG. 18 is a cross-sectional view illustrating the state that the tab guide of the related art sheet conveying apparatus is attached.
Figure 19:
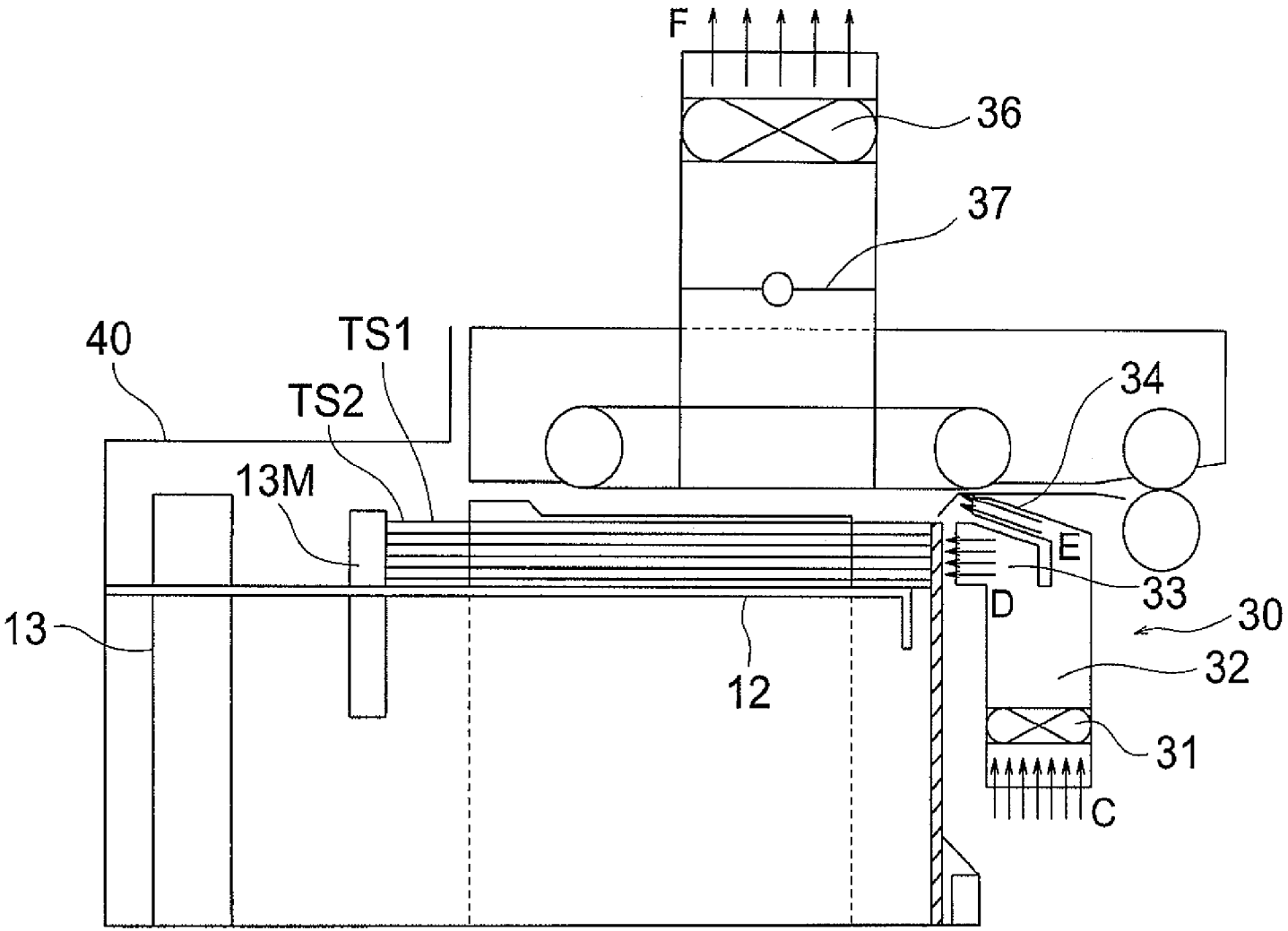
FIG. 19 PRIOR ART
FIG. 19 is a cross-sectional view illustrating the state that another tab guide of the related art sheet conveying apparatus is attached.

The upper component may be separated from the trailing edge separation portion so as to move the trailing edge separation portion upward. In such cases, however, as described in FIG. 18, the distance between the trailing edge regulation portion and the component located above the trailing edge regulation portion need be increased in the entire range in which the trailing edge regulation portion is moved. Then the apparatus is made larger and becomes expensive.

Figure 11B:
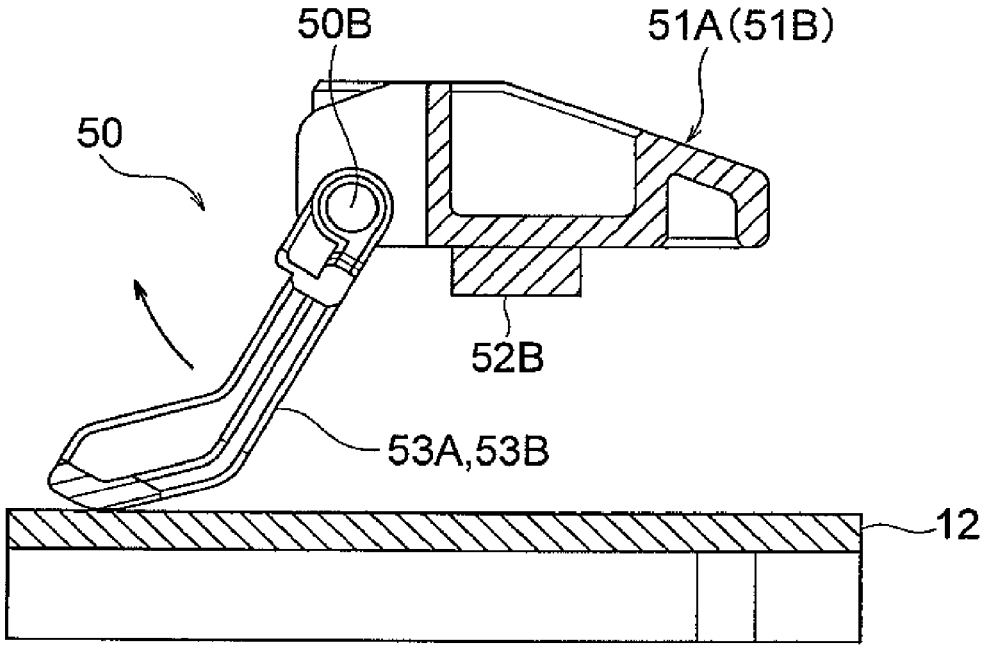
Figure 12:
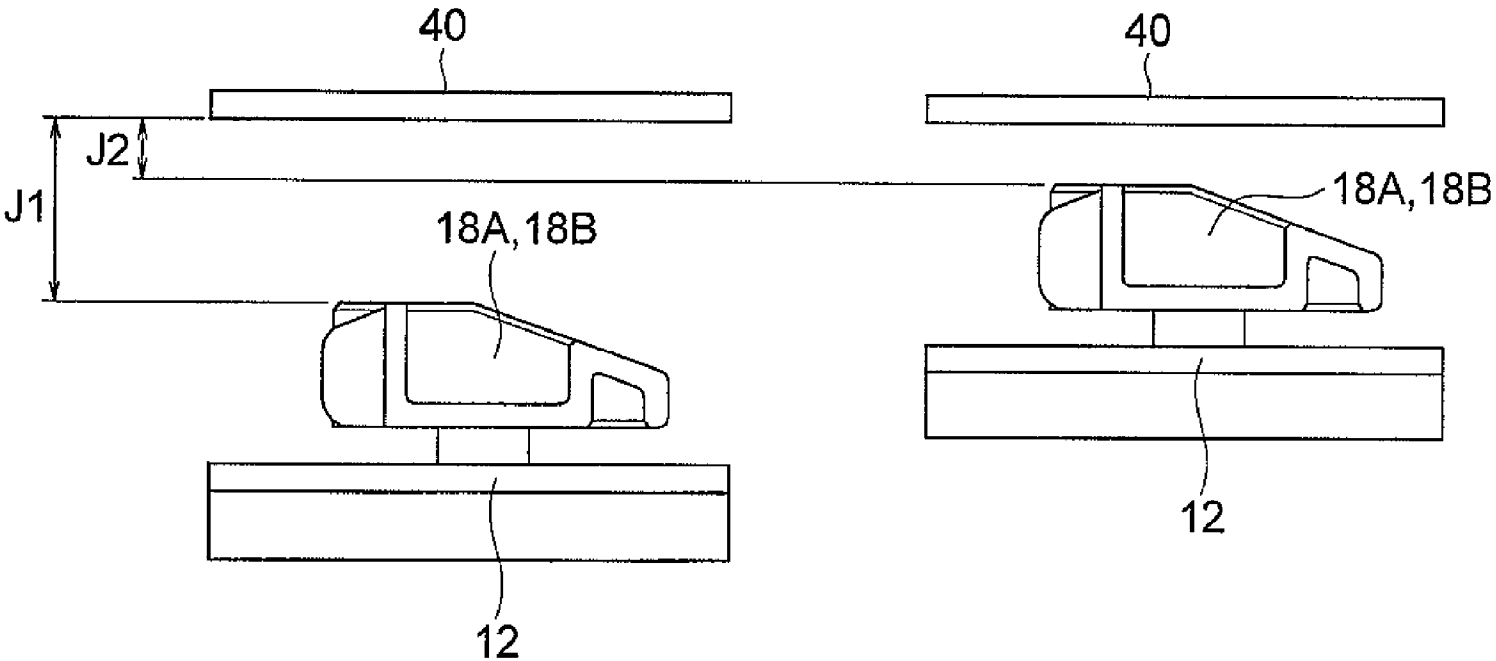
FIG. 12 is a diagram describing the operation of the trailing edge separation portion when the tabbed sheet regulation unit is not provided.
Figure 13:
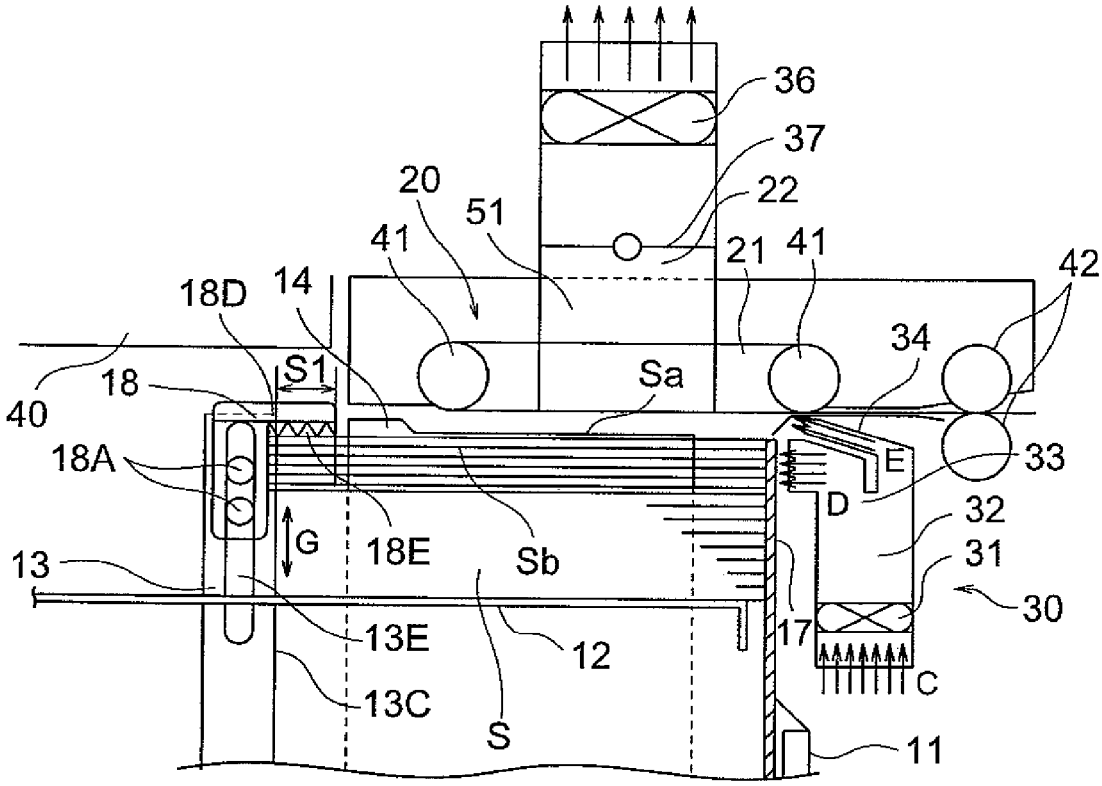
FIG. 13 PRIOR ART
FIG. 13 is a diagram describing the configuration of a related art sheet conveying apparatus.
Figure 14:
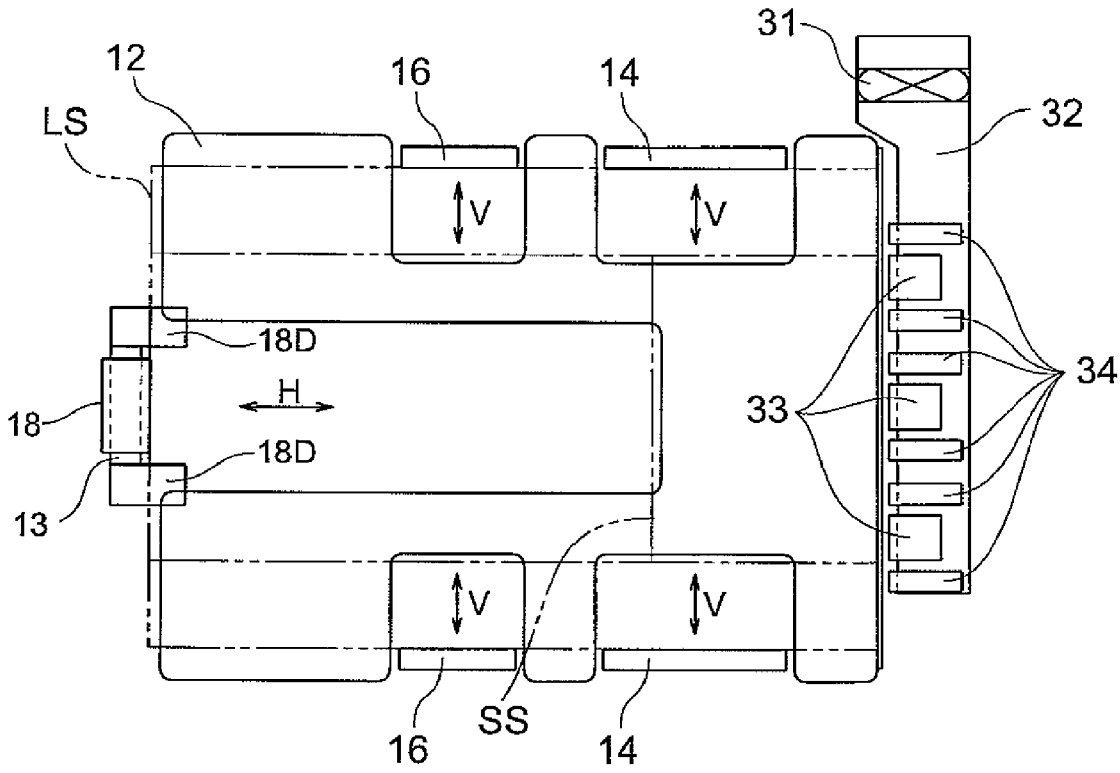
FIG. 14 PRIOR ART
FIG. 14 is a plan view illustrating the detail of a storage case of the related art sheet conveying apparatus.
Figure 15A:
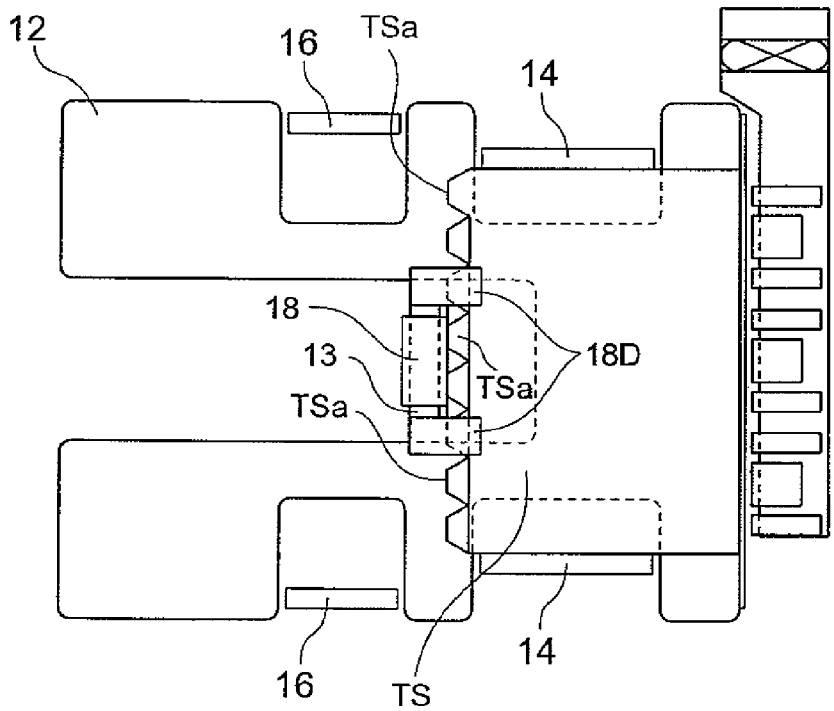
FIG. 15A PRIOR ART
FIGS. 15A and 15B are plan views illustrating the state that a tabbed sheet stored in the storage case is conveyed.
Figure 15B:
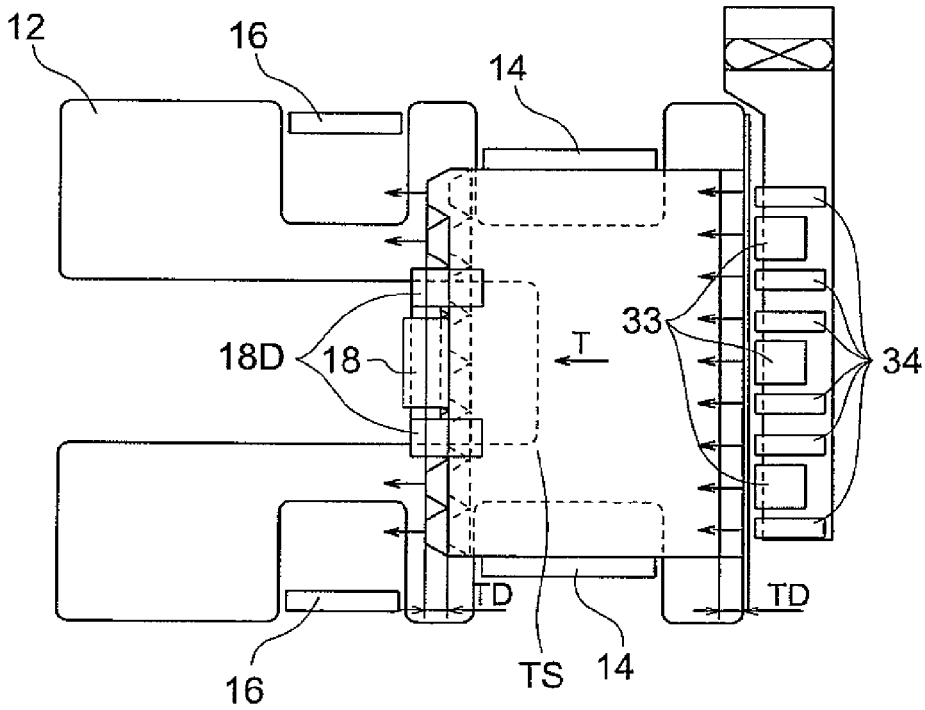
FIG. 15B PRIOR ART

In this embodiment, as already described, the tab portion regulation portions 53A and 53B are rotatably supported by the regulation unit body 50A. As illustrated in FIG. 11A, the tray 12 is abutted on the ends of the tab portion regulation portions 53A and 53B. As illustrated in FIG. 11B, the tab portion regulation portions 53A and 53B are rotated about a rotational shaft 50B provided in the regulation unit body 50A as a supporting point in the direction of the arrow.

When the tray 12 is abutted, the tab portion regulation portions 53A and 53B are rotated (moved) with the lifting of the tray 12. Thus the substantial thickness of the trailing edge separation portion 18 is the same as the case that the regulation unit 50 is not attached. In the event of a malfunction of the tray 12, the safety device can be operated, so that the tabbed sheet can be regulated without the collision of the lifting tray with the apparatus.

In this manner, the tab portion regulation portions 53A and 53B are rotatably supported, and the damage of the apparatus can be prevented very easily and inexpensively. Further, the amount of the tabbed sheets stacked and supported on the tray 12 can be increased.

As illustrated in FIGS. 8A and 8B, plural slits 530A and 530B which are holes through which air passes are formed in the tab portion regulation portions 53A and 53B so that air blown from the leading edge of the sheet can be flowed rearward smoothly. When the plural slits 530A and 530B are formed, a force is applied to the tab portion regulation portions 53A and 53B in the direction rotating the tab portion regulation portions 53A and 53B by air flowing through the slits 530A and 530B.

In this embodiment, the weight of rotation end side portions 531A and 531B of the tab portion regulation portions 53A and 53B illustrated in FIG. 11A separated from the rotation center is larger than that of the rotation center. With this configuration, when a force by air is applied, the tab portion regulation portions 53A and 53B cannot be rotated. The regulation performance of the tab portion regulation portions 53A and 53B can be maintained.

As described above, the regulation unit 50 having the tab portion regulation portions 53A and 53B integrally moved with the tray 12 is provided at the upper end of the trailing edge regulation plate 13, so that the amount of the tabbed sheets stacked can be increased. Further, when the tabbed sheet is conveyed, high operability and productivity can be obtained.

In this embodiment, there is described the example in which the present invention is applied to the sheet conveying apparatus of an air sheet feeding system. The present invention is not limited to this and is applicable to a sheet conveying apparatus of the type to lift and lower the sheet by the tray by the sheet conveying system by a roller. In such cases, the amount of the tabbed sheets stacked can be increased and high operability can be obtained, and the increase in the interval of the sheets conveyed continually can be prevented and the lowering of the productivity can be prevented. The occurrence of a delay jam can be prevented.

In this embodiment, the tabbed sheet regulation unit is detachably attached when the tabbed sheet is used. However, the present invention is not limited to this. In the sheet conveying apparatus only for the tabbed sheet, the tabbed sheet regulation unit may be fixedly provided to the trailing edge regulation plate 13 or may be provided to the side regulation plate 14 according to the storage direction of the tabbed sheet.

Further, in this embodiment, the position of the tabbed sheet is regulated by the trailing edge regulation plate 13 and the regulation unit 50. The present invention is not limited to this, however, and the position of the tabbed sheet may be regulated only by the regulation unit 50.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-263003, filed Oct. 9, 2008, which is hereby incorporated by reference herein in its entirety.

What is claimed is:

1. A sheet conveying apparatus comprising:

a tray provided in a sheet storage portion so as to be lifted and lowered;

a sheet conveying portion which conveys the uppermost one of sheets supported on the tray at a predetermined conveying height position;

a regulation portion which is provided in the sheet storage portion and regulates the position of the sheet supported on the tray;

a separation portion which is supported by the regulation portion so as to be slidable in up and down directions and which presses from above the upper surface of the uppermost sheet stacked on the tray to separate the sheets; and a tabbed sheet regulation unit which is detachably attached to the separation portion and which has a tab portion regulation portion which is abutted on a tab portion of a tabbed sheet to regulate the position of the tabbed sheet when the tabbed sheet is stacked on the tray, wherein the tab portion regulation portion is movably provided in the tabbed sheet regulation unit so as to be moved when the tray is lifted and abutted against the tab portion regulation portion.

2. The sheet conveying apparatus according to claim 1, wherein when the tray which is lifted to locate the uppermost sheet in the conveying height position is abutted on the tab portion regulation portion, the tab portion regulation portion is moved with the lifting of the tray.

3. The sheet conveying apparatus according to claim 1, wherein when the tray which continues to be lifted due to a malfunction is abutted on the tab portion regulation portion, the tab portion regulation portion is moved with the lifting of the tray.

4. The sheet conveying apparatus according to claim 1, further comprising:

a separation member which adds resistance to the upper surface of the sheet stacked on a sheet abutment surface of the separation portion, wherein the tabbed sheet regulation unit is attached to the separation portion in the portion other than the region in which the separation member of the separation portion is provided.

5. The sheet conveying apparatus according to claim 1, wherein the tabbed sheet regulation unit has a separation member which has an abutment surface pressing the upper surface of the uppermost tabbed sheet stored in the sheet storage portion from above and adds resistance to the upper surface of the sheet stacked on the abutment surface.

6. The sheet conveying apparatus according to claim 1, wherein the sheet conveying portion has an air blowing portion which blows air for blowing up the sheet supported on the tray, and an absorption conveying portion which absorbs and conveys the sheet blown up by the air blowing portion, and the tab portion regulation portion has a hole through which air blown out from the air blowing portion passes.

7. The sheet conveying apparatus according to claim 1, wherein the tab portion regulation portion is rotatably attached to a regulation unit body and the tab portion regulation portion is configured such that the weight of the rotation end side portion away from the rotation center is larger than that of the rotation center.

8. An image forming apparatus comprising:

a tray provided in a sheet storage portion so as to be lifted and lowered;

a sheet conveying portion which conveys the uppermost one of sheets supported on the tray at a predetermined conveying height position;

an image forming portion which forms an image on the sheet conveyed by the sheet conveying portion;

a regulation portion which is provided in the sheet storage portion and regulates the position of the sheet supported on the tray;

a separation portion which is supported by the regulation portion so as to be slidable in up and down directions and which presses from above the upper surface of the uppermost sheet stacked on the tray to separate the sheets; and a tabbed sheet regulation unit which is detachably attached to the separation portion and has a tab portion regulation portion which is abutted on a tab portion of a tabbed sheet to regulate the position of the tabbed sheet when the tabbed sheet is stacked on the tray, wherein the tab portion regulation portion is movably provided in the tabbed sheet regulation unit so as to be moved when the tray is lifted and abutted against the tab portion regulation portion.

9. The image forming apparatus according to claim 8, wherein when the tray which is lifted to locate the uppermost sheet in the conveying height position is abutted on the tab portion regulation portion, the tab portion regulation portion is moved with the lifting of the tray.

10. The image forming apparatus according to claim 8, wherein when the tray which continues to be lifted due to a malfunction is abutted on the tab portion regulation portion, the tab portion regulation portion is moved with the lifting of the tray.

11. The image forming apparatus according to claim 8, further comprising:

a separation member which adds resistance to the upper surface of the sheet stacked on a sheet abutment surface of the separation portion, wherein the tabbed sheet regulation unit is attached to the separation portion in the portion other than the region in which the separation member of the separation portion is provided.

12. The image forming apparatus according to claim 8, wherein the tabbed sheet regulation unit has a separation member which has an abutment surface pressing the upper surface of the uppermost tabbed sheet stored in the sheet storage portion from above and adds resistance to the upper surface of the sheet stacked on the abutment surface.

13. The image forming apparatus according to claim 8, wherein the sheet conveying portion has an air blowing portion which blows air for blowing upward the sheet supported on the tray, and an absorption conveying portion which absorbs and conveys the sheet blown upward by the air blowing portion, and the tab portion regulation portion has a hole through which air blown out from the air blowing portion passes.

14. The image forming apparatus according to claim 8, wherein the tab portion regulation portion is rotatably attached to a regulation unit body and the tab portion regulation portion is configured such that the weight of the rotation end side portion away from the rotation center is larger than that of the rotation center.

* * * * *